US006257635B1

(12) United States Patent
Torelli

(10) Patent No.: US 6,257,635 B1
(45) Date of Patent: Jul. 10, 2001

(54) GOLF BALL RETRIEVER

(76) Inventor: V. Victor Torelli, 21-32 Wallace Ave., Bronx, NY (US) 10462

( * ) Notice: Subject to any disclaimer, the term of this patent is extended or adjusted under 35 U.S.C. 154(b) by 0 days.

(21) Appl. No.: 09/464,913

(22) Filed: Dec. 16, 1999

(51) Int. Cl.[7] ..... A63B 47/02
(52) U.S. Cl. ..... 294/19.2
(58) Field of Search ..... 294/19.1, 19.2, 294/66.1; 56/328.1, 332; 473/286

(56) References Cited

U.S. PATENT DOCUMENTS

| | | | | |
|---|---|---|---|---|
| 698,226 | * | 4/1902 | Roberts | 294/19.2 |
| 3,046,044 | * | 7/1962 | Christle | 294/19.2 |
| 3,136,573 | * | 6/1964 | Harke | 294/19.2 |
| 3,770,308 | * | 11/1973 | Faber et al. | 294/19.2 |
| 3,820,836 | * | 6/1974 | Seewagen et al. | 294/19.2 |
| 4,313,632 | * | 2/1982 | King | 294/19.2 |
| 5,080,413 | * | 1/1992 | Vobeda | 294/19.2 |

FOREIGN PATENT DOCUMENTS

| | | | | |
|---|---|---|---|---|
| 416810 | * | 9/1934 | (GB) | 294/19.2 |

* cited by examiner

*Primary Examiner*—Johnny D. Cherry
(74) *Attorney, Agent, or Firm*—Dilworth & Barrese, LLP

(57) ABSTRACT

A golf ball retriever comprising a distal end with a frame comprising a plurality of side walls with recesses for the engaging, trapping, and retaining of golf balls therein. The frame also includes a bore in the bottom of the frame with an adjacent retaining structure for passing and retaining multiple golf balls simultaneously therein. An alternative embodiment includes a distal end frame with a plurality of golf ball manipulators and a bore in the bottom of the frame with an adjacent retaining structure. The distal end is removably connected to a pole on the proximal end that is variable in length that can extend up to 20 feet.

6 Claims, 2 Drawing Sheets

GOLF BALL RETRIEVER

BACKGROUND

TECHNICAL FIELD OF THE INVENTION

The present invention relates to ball retrievers. More particularly, the invention is directed to golf ball retrievers for acquiring and remotely retrieving golf balls.

SUMMARY OF THE INVENTION

The present invention provides a novel golf ball retriever including a distal frame having a plurality of sidewalls with recesses formed therein for the retrieval of golf balls from the front or sides. In addition, the frame further includes a trap door positioned adjacent the bottom for retrieving golf balls. The golf ball retriever is capable of retrieving multiple golf balls simultaneously. An elongate pole is connected adjacent a proximal portion of the frame and serves to extend the reach of the user. The distal frame is removably attached to the pole and an alternative embodiment with a plurality of prong type golf ball manipulators can be substituted on the pole for retrieving golf balls under different circumstances.

BRIEF DESCRIPTION OF THE DRAWINGS

The present invention is illustrated in the accompanying sheet of figures wherein.

DETAILED DESCRIPTION OF THE PREFERRED EMBODIMENT

Figure 1:
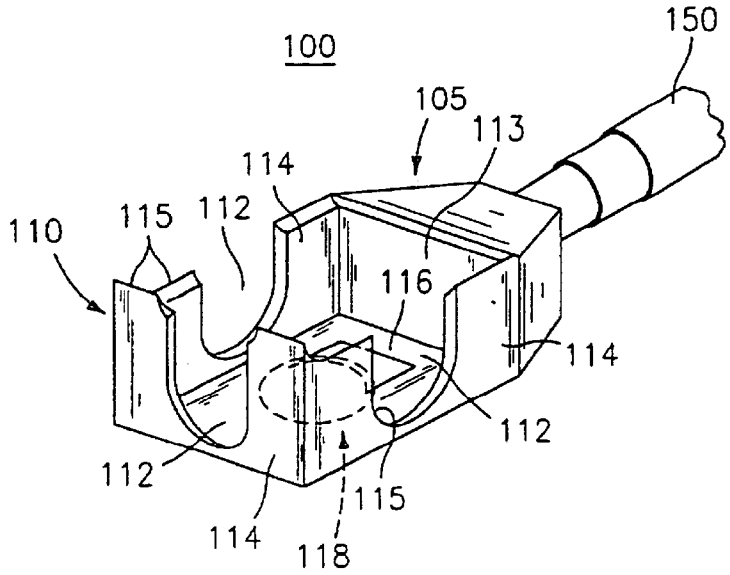
FIG. 1 is an elevated perspective view of the frame showing the recesses in the front and side walls and the trap door positioned on the bottom.

Referring to the drawings in detail, and initially to FIG. 1, the present invention provides a novel golf ball retriever 100 including a distal end portion comprising a frame 110 having a plurality of recesses 112 formed in juxtaposed sidewalls 114. Frame 110 further includes a trap door 118 positioned adjacent the bottom 116. Proximal end portion includes an elongate pole 150 which is connected to the proximal end 105 of frame 110 and provides a variable length extension to aid the user in reaching golf balls. Pole 150 can be circular, square, or rectangular in cross section.

Frame 110 includes a plurality of recesses 112 formed in the juxtaposed sidewalls 114 and/or front walls 114 of the frame structure 110 as shown in the accompanying figures. These recesses 112 enable the user to engage the ball from either the left, right, or front side of frame 110 to entrap and direct the ball into frame structure 110. Similarly, frame portion 110 in one configuration-includes beveled edges 115 on walls 114 that are positioned to aid the user in scooping the ball into frame 110. For example, these features are particularly efficient in soft mud or under water where a ball is visible but embedded in a material. Golf ball retriever 100 can be manipulated in any orientation including upside down, to unearth and recover the ball.

In a particularly preferred embodiment, frame 110 includes an opening 112 defined by edges 115 of sidewalls 114 that form an open receptacle frame structure 110. This structure of frame 110 facilitates the catapulting of the ball out of the frame to the handler with a simple flick of the wrist. This eliminates the need to retract pole 150 between individual ball recoveries. As an alternative, golf ball retriever 100 can simultaneously retrieve multiple golf balls which can be retained in frame 110 for the expeditious recovery of multiple balls.

Figure 2:
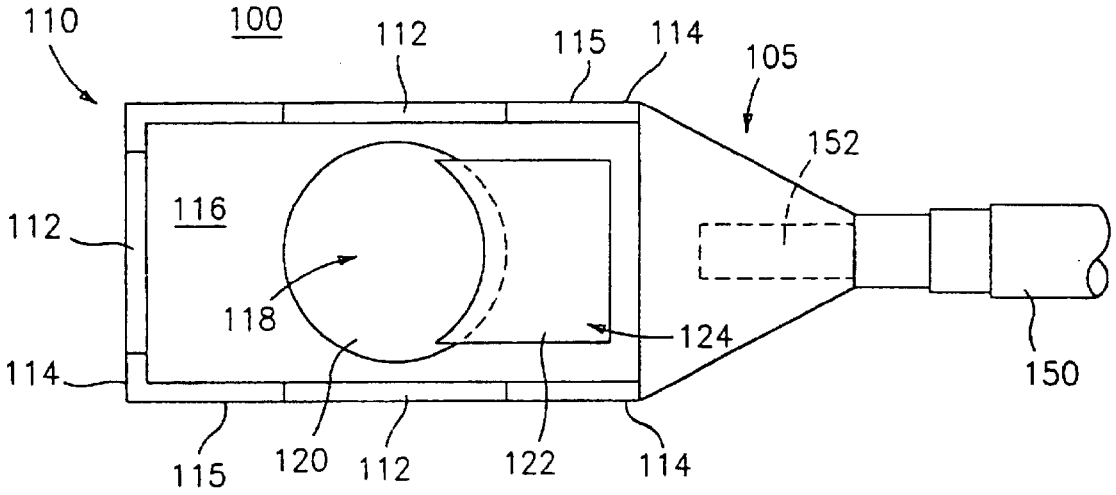
FIG. 2 is a top view of the frame and trap door.

In FIG. 2, trap door 118 comprises a bore 120 dimensioned to be larger than a golf ball. A one way retaining structure 124, in the form of a flexible flap 122, is positioned adjacent bore 120 in a manner to permit a golf ball to pass through bore 120 from outside frame 110 to an interior portion of frame 110 with flap 122 precluding the exit of the ball through the same bore 120. Preferably, flap 122 structure is positioned on the inside portion of frame 110 and biased such that flap 122 is maintained adjacent the bore 120. In this embodiment the flexibility of flap 122 permits a golf ball to enter frame 110 and the subsequent downward biasing precludes the ball from exiting once it passes flap 122 structure. One way retaining structure 124 could be configured as a cantilevered leaf spring, for example, that is similarly biased and thus could also preclude balls from exiting frame 110.

Frame portion 110 can be formed of any appropriate material, but preferably a metal or molded plastic. The shape of frame portion 110 can be configured in any structural form, such as a cube, sphere or variations thereof, that sustains the ability of the device to provide a plurality of recesses 112 for the lateral and frontal retrieval of golf balls while providing trap door 118 in bottom 116. In a particularly preferred embodiment, the overall frame portion 110 is approximately three (3) inches long, approximately two and one-half (2½) inches wide, one and three-sixteenths (1 3/16) inches in height, with the juxtaposed sidewalls 114 defining a recess 112 of approximately three quarters of an inch (¾"). An alternative most preferred embodiment includes a frame portion that is four (4) inches long, approximately one and seven-eighths (1⅞) inches wide, one and seven-eighths (1⅞) inches in height, with the juxtaposed sidewalls 114 defining a recess 112 of approximately one and five-sixteenths (1 5/16) inches in height. This second embodiment is dimensioned to allow the passage of the golf ball retriever 100 through the hole of a smaller sized wire anchor fence which has approximately a two-inch opening.

Frame portion 110 also includes beveled edges 115 on walls 114 for assisting in scooping up golf balls. Bottom 116 of frame 110 containing bore 120 and adjacent trap door 118 is preferably flat, but could be concave or recessed, with bore 120 formed with a one and three quarter inch (1¾") diameter and a flap 122 structure overlay of about three thirty-seconds of an inch (3/32"). The retractable pole 150 is connected to proximal portion 105 of frame 110 using an attachment mechanism 152, such as a threaded connection. Pole 150 is capable of varying its length and includes the capability to extend out to a maximum length between fifteen (15) and twenty (20) feet in the preferred embodiment.

Figure 3:
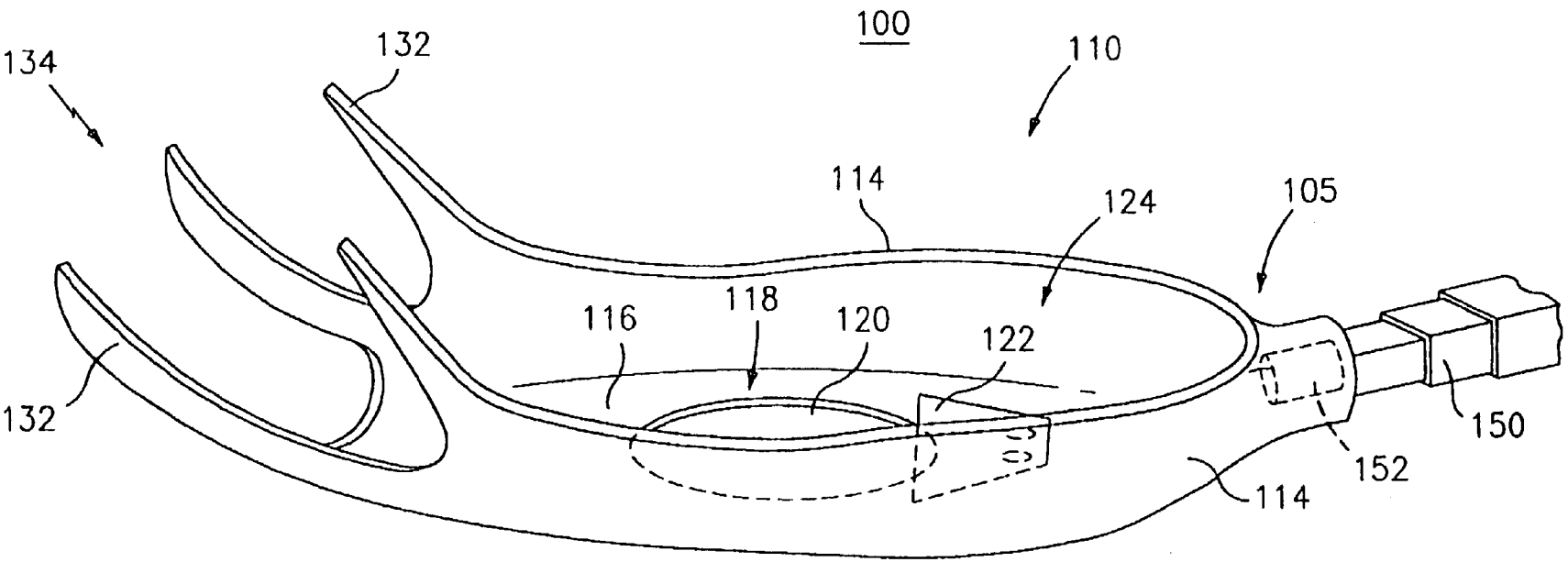
FIG. 3 is an elevated side view of an alternative embodiment of the golf ball retriever with a plurality of ball manipulators.

Referring now to FIG. 3, golf ball retriever 100 is shown in an alternative embodiment wherein frame 110 contains a distal end 134, a proximal end 105, a bottom 116, and sidewalls 114. A plurality of ball manipulators 132 are formed on distal end 134 and sidewalls 114. Frame 110 includes a trap door 118 positioned adjacent bottom 116. Trap door 118 comprises a bore 120 dimensioned to be larger than a golf ball. One way retaining structure 124, in the form of a flexible flap 122, is positioned adjacent bore 120 in a manner to permit a golf ball to pass through bore 120 from outside frame 110 to an interior portion of frame 110 with flap 122 precluding exit of the ball through the same bore 120. Preferably, flap 122 structure is positioned on the inside portion of frame 110 and biased such that flap 122 is maintained adjacent bore 120. In this embodiment, the flexibility of flap 122 permits a golf ball to enter the frame and the subsequent downward biasing precludes the ball from exiting once it passes flap 122 structure.

Ball manipulators 132 are positioned on both sidewall portions 114 of frame 110 and work in unison with the distal end to permit frame 110 to operate in a variety of orientations depending on the particular situation. Ball manipulators 132 on frame 110 also enable the user to reach underneath and behind the ball to entrap and direct the ball into the structure of frame 110. For example, this configuration is particularly efficient in soft mud or under water where a ball is visible but embedded in a material. The unit can be manipulated in any orientation including upside down and the prongs can be used to unearth the ball and subsequently recover a buried ball.

In a particularly preferred embodiment, frame 110 forms a general pan like shape with a bottom 116 and sidewalls 114 that define an opening 113. Bottom 116 of frame 110 is preferably flat, but could be concave or recessed. This open frame 110 structure facilitates the catapulting of the ball to the handler with a simple flick of the wrist. This eliminates the need to retract pole 150 with each recovery and allows for a more expeditious recovery of multiple balls.

An elongate pole 150 is connected to the proximal end 105 of frame 110 using an attachment mechanism 152, such as a threaded connection, and serves to extend the reach of the user. In a particularly preferred embodiment, pole 150 can be of a square or rectangular configuration to provide strength and rigidity. It is also envisioned that the pole 150 could be telescopically configured to vary the reach of the frame portion 110. The retractable pole structure 150 extends to a maximum length of between fifteen (15) and twenty (20) feet.

Distal end frames 110 of golf ball retriever 100 are removably attached to pole 150 and enable each embodiment to be removably replaced by the user using an attachment mechanism 152, such as a threaded device. Golf ball retriever 100 is configurable as a kit with replaceable distal ends 105 or individually with separate poles 150.

Although the illustrative embodiments of the present disclosure have been described herein with reference to the accompanying drawings, it is to be understood that the disclosure is not limited to those precise embodiments, and that various other changes and modifications may be affected therein by one skilled in the art without departing from the scope or spirit of the disclosure. All such changes and modifications are intended to be included within the scope of the disclosure.

I claim:

1. A golf ball retriever comprising:

a distal end having an open frame, said open frame having a bottom, said frame defining a bore dimensioned and configured to admit a golf ball therethrough;

a one way retaining structure positioned adjacent to said bore for preventing the golf ball from passing out of said bore; wherein said retaining structure is a flexible one way flap that allows golf balls to pass through said bore in said bottom and into said frame and precludes the exiting of golf balls from said bore;

a plurality of sidewalls defined on said frame, each of said sidewalls including a slot configured and dimensioned to permit a golf ball to be retained and scooped into said frame; and an extension pole connected to said distal end.

2. A golf ball retriever comprising:

a distal end having an open frame, said open frame having a bottom, said frame defining a bore dimensioned and configured to admit a golf ball therethrough;

a one way retaining structure positioned adjacent said bore for preventing the golf ball from passing out of said bore;

a plurality of sidewalls defined on said frame, each of said sidewalls including a slot configured and dimensioned to permit a golf ball to be retained and scooped into said frame, wherein said plurality of slots formed in said sidewalls are beveled along a top portion thereof to assist in retrieving golf balls therein; and an extension pole connected to said distal end.

3. A golf ball retriever comprising:

a distal end having an open frame having a bottom, a front wall and a plurality of sidewalls, wherein said plurality of sidewalls and said front wall contain slots sized to entrap and retain a plurality of golf balls therein, wherein said plurality of slots formed in said sidewalls are beveled along a top portion thereof to assist in retrieving golf balls therein;

a trap door with a one way retaining structure positioned adjacent to said bottom of said frame; and an extension pole connected to said distal end.

4. A golf ball retriever comprising:

a distal end having an open frame formed by a contiguous sidewall and a bottom configured to retain multiple golf balls simultaneously, said distal end including a plurality of golf ball manipulators;

a one way retaining structure with a flexible flap positioned adjacent a bore defined in said bottom for preventing said golf balls from passing out of said bore; and a telescoping pole connected to said open frame.

5. The golf ball retriever of claim 4, wherein the pole has a square cross section.

6. The golf ball retriever of claim 4, wherein the pole is removably connected to the frame.

* * * * *